US011332906B2

(12) United States Patent
Collins et al.

(10) Patent No.: US 11,332,906 B2
(45) Date of Patent: May 17, 2022

(54) GROUT PLUG SYSTEMS AND METHODS FOR PLACING PILES

(71) Applicant: American Piledriving Equipment, Inc., Kent, WA (US)

(72) Inventors: Dan Collins, Kent, WA (US); Dan Miller, Kent, WA (US)

(73) Assignee: AMERICAN PILEDRIVING EQUIPMENT, INC., Kent, WA (US)

( * ) Notice: Subject to any disclaimer, the term of this patent is extended or adjusted under 35 U.S.C. 154(b) by 62 days.

(21) Appl. No.: 17/030,150

(22) Filed: Sep. 23, 2020

(65) Prior Publication Data

US 2021/0108388 A1 Apr. 15, 2021

Related U.S. Application Data

(60) Provisional application No. 62/905,523, filed on Sep. 25, 2019.

(51) Int. Cl.

| | |
|---|---|
| ***E02D 13/00*** | (2006.01) |
| ***E02D 7/06*** | (2006.01) |
| ***E02D 5/24*** | (2006.01) |
| *E02D 5/52* | (2006.01) |

(52) U.S. Cl.

CPC ..... *E02D 13/00* (2013.01); *E02D 5/24* (2013.01); *E02D 7/06* (2013.01); *E02D 5/523* (2013.01); *E02D 2200/1685* (2013.01); *E02D 2250/003* (2013.01); *E02D 2300/0001* (2013.01); *E02D 2300/0026* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,942,430 | B1 * | 9/2005 | Suver | E02D 5/56 405/232 |
| 9,388,548 | B2 * | 7/2016 | Suver | E02D 7/22 |
| 9,416,512 | B2 * | 8/2016 | Suver | E02D 5/32 |
| 9,611,610 | B2 * | 4/2017 | Suver | E02D 5/285 |
| 9,611,611 | B2 * | 4/2017 | Klekotka | E21B 33/13 |
| 9,637,883 | B2 * | 5/2017 | Suver | E02D 5/285 |
| 9,650,753 | B2 * | 5/2017 | Suver | E02D 5/56 |
| 9,856,619 | B2 * | 1/2018 | Suver | E02D 5/56 |
| 2005/0201836 | A1 * | 9/2005 | Suver | E02D 5/56 405/232 |

(Continued)

*Primary Examiner* — Kyle Armstrong
(74) *Attorney, Agent, or Firm* — Schacht Law Office, Inc.; Michael R. Schacht

(57) ABSTRACT

A grout plug assembly for use in forming a pipe pile system defining at least one pile assembly inner surface portion comprises a resiliently deformable plug body and a substantially rigid plug cap. The resiliently deformable plug body defining a plug outer surface, a plug inner surface, a first plug end surface, a second plug end surface, where the plug inner surface defines a plug passageway. The substantially rigid plug cap defines a cap outer surface, a cap inner surface, a first cap end surface, and a second cap end surface. The second cap end surface is rigidly secured to the first plug end surface. The plug outer surface is sized and dimensioned to engage the at least one pile assembly inner surface portion of the pipe pile system during formation of the pipe pile system.

20 Claims, 15 Drawing Sheets

(56) References Cited

U.S. PATENT DOCUMENTS

| | | | | |
|---|---|---|---|---|
| 2013/0272798 | A1* | 10/2013 | Paul | E02D 7/06 405/233 |
| 2013/0272799 | A1* | 10/2013 | Suver | E02D 7/00 405/233 |
| 2014/0056652 | A1* | 2/2014 | Suver | F16L 23/00 405/249 |
| 2014/0105689 | A1* | 4/2014 | Klekotka | E21B 33/13 405/233 |
| 2015/0345094 | A1* | 12/2015 | Suver | E02D 5/526 405/241 |
| 2015/0345095 | A1* | 12/2015 | Suver | E02D 5/20 405/233 |
| 2015/0345097 | A1* | 12/2015 | Suver | E02D 7/06 405/251 |
| 2017/0191238 | A1* | 7/2017 | Suver | E02D 5/54 |
| 2018/0002885 | A1* | 1/2018 | Sun | H02S 20/10 |
| 2019/0169834 | A1* | 6/2019 | Marshall | E02D 27/02 |

* cited by examiner

GROUT PLUG SYSTEMS AND METHODS FOR PLACING PILES

RELATED APPLICATIONS

This application claims benefit of U.S. Provisional Application Ser. No. 62/905,523 filed Sep. 25, 2019, the contents of which are incorporated herein by reference.

TECHNICAL FIELD

The present invention relates to systems and methods for placing piles into the ground and, more particular, to grout plug systems and methods for pipe piling placement with continuous grouting.

BACKGROUND

Vibratory and rotary drivers are used for the installation of pipe piling. Pipe piles, as used in the installation of structural foundations or geothermal piles, are segments of pipe that must be connected and driven together from the surface to reach the desired depth. Consequently, whether used in connection with vibratory or rotary drivers, the connection between pipe pile segments is vitally important to maximizing the driving power and reducing the possibility of failure of the pipe segment connection points. As the length of the column increases, weaknesses in the junctions between the pipe pile segments weaken the entire column, making it important to limit movement in the junctions. The installation of pipe pilings may be improved in stability and/or strength when installed with grout or similar material along the exterior of the column.

The need exists for improved grout plug systems and methods for use when placing piles

SUMMARY

The present invention may be embodied as a grout plug assembly for use in forming a pipe pile system defining at least one pile assembly inner surface portion, where the grout plug assembly comprises a resiliently deformable plug body and a substantially rigid plug cap. The resiliently deformable plug body defines a plug outer surface, a plug inner surface, a first plug end surface, a second plug end surface, where the plug inner surface defines a plug passageway. The substantially rigid plug cap defining a cap outer surface, a cap inner surface, a first cap end surface, and a second cap end surface. The second cap end surface is rigidly secured to the first plug end surface. The plug outer surface is sized and dimensioned to engage the at least one pile assembly inner surface portion of the pipe pile system during formation of the pipe pile system.

The present invention may also be embodied as a method of forming a pipe pile system defining at least one pile assembly inner surface portion comprising the following steps. A resiliently deformable plug body defining a plug outer surface, a plug inner surface, a first plug end surface, a second plug end surface is provided. The plug inner surface defines a plug passageway, and the plug outer surface is sized and dimensioned based on size and dimensions of the at least one pile assembly inner surface portion of the pipe pile system. A substantially rigid plug cap defining a cap outer surface, a cap inner surface, a first cap end surface, and a second cap end surface is provided. A grout plug is formed by rigidly securing the second cap end surface to the first plug end surface. The grout plug is arranged such that the plug outer surface engages the at least one pile assembly inner surface portion during formation of the pipe pile system.

The present invention may also be embodied as a pile driving system for use in forming a pipe pile system defining at least one pile assembly inner surface portion. In this example of the present invention, the pile driving system comprises a support system, a drive assembly, and a grout plug assembly. The support system supports at least one pipe pile above a desired location in the ground. The drive assembly is configured to displace the at least one pipe pile into the ground at the desired location. The grout plug assembly comprises a resiliently deformable plug body and a substantially rigid plug cap. The resiliently deformable plug body defining a plug outer surface, a plug inner surface, a first plug end surface, a second plug end surface, where the plug inner surface defines a plug passageway. The substantially rigid plug cap defining a cap outer surface, a cap inner surface, a first cap end surface, and a second cap end surface. The second cap end surface is rigidly secured to the first plug end surface, and the plug outer surface is sized and dimensioned to engage the at least one pile assembly inner surface portion of the pipe pile system during formation of the pipe pile system. The at least one plug outer surface is arranged to engage the at least one pile assembly inner surface portion. At least one of the support system and the drive system are operated to displace the pile system into the ground. Grout is displaced through the plug passageway when the pile system is displaced into the ground.

DETAILED DESCRIPTION

The present invention may take several forms and/or may be used in different configurations, and several different forms and/or configurations of the present invention will be described separately below.

I. First Example Embodiment

Figure 1:
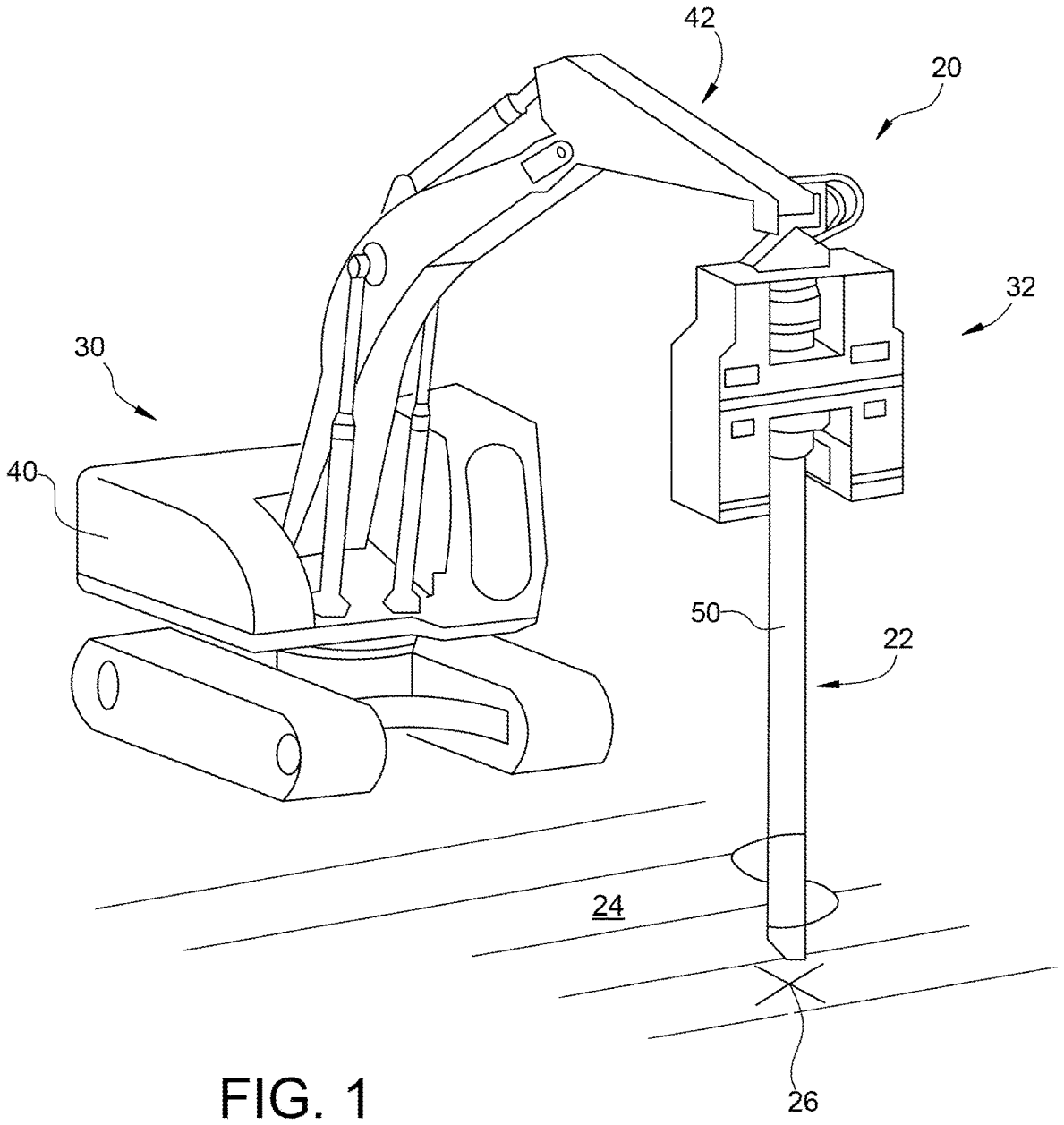
FIG. 1 is a perspective view of an example pile placing embodying a first example grout plug system and example grout plug method of the present invention.

A first example of the present invention will initially be described with reference to FIGS. 1-17 of the drawing. FIG. 1 illustrates an example piledriving system 20 configured to drive a first example pile assembly 22 into the ground 24 at a desired location 26. The example piledriving system 20 comprises a support system 30 and a drive assembly 32.

The example support system 30 is a vehicle 40 comprising a boom 42 configured to support the drive assembly 32. The vehicle 40 may be a mobile crane (as shown), backhoe, gantry, or other mobile system capable of supporting the drive assembly 32. Alternatively, the support system 30 may be supported by a carriage (not shown) that may be movable up and down along a portable tower (not shown) as disclosed, for example, in U.S. Pat. No. 7,950,876, which is incorporated herein by reference. The example support system 30 is or may be conventional and will not be described herein in further detail beyond what is helpful for a complete understanding of the present invention.

The drive assembly 32 is configured to be supported above the desired location 26 in the ground 24 and operated to insert the first example pile assembly 22 into the ground 24 at the desired location 26. Examples of the drive assembly 32 can be found in U.S. Pat. Nos. 6,386,295 and 6,942,430, which are incorporated herein by reference. The example drive system 32 is or may be conventional and will be described herein to that extent helpful for a complete understanding of the present invention.

The example pile assembly 22 comprises at least one pipe member 50 that is attached to and suspended from the drive assembly 32 prior to and during insertion into the ground 24. The pile assembly 22 typically includes a plurality of pipe members 50 and other pipe elements, such as couplers and fittings as will be described below, configured to allow the pile assembly 22 to satisfy design characteristics such as stability of the pile assembly 22 when under load. The design characteristics of the pile assembly 22 will be determined based on the nature of the load to be applied to the pile assembly 22 and other considerations such as characteristics of the ground 24 at the desired location 26. These design characteristics may determine diameter and wall thickness of the pipe member 50 and any associated couplers and fittings, the length of the pile assembly 22, and whether the pipe assembly 22 is to be filled with grout (not shown). The pile assembly 22 and components thereof are or may be conventional and will not be described herein in further detail beyond what is helpful for a complete understanding of the present invention.

Figure 2:
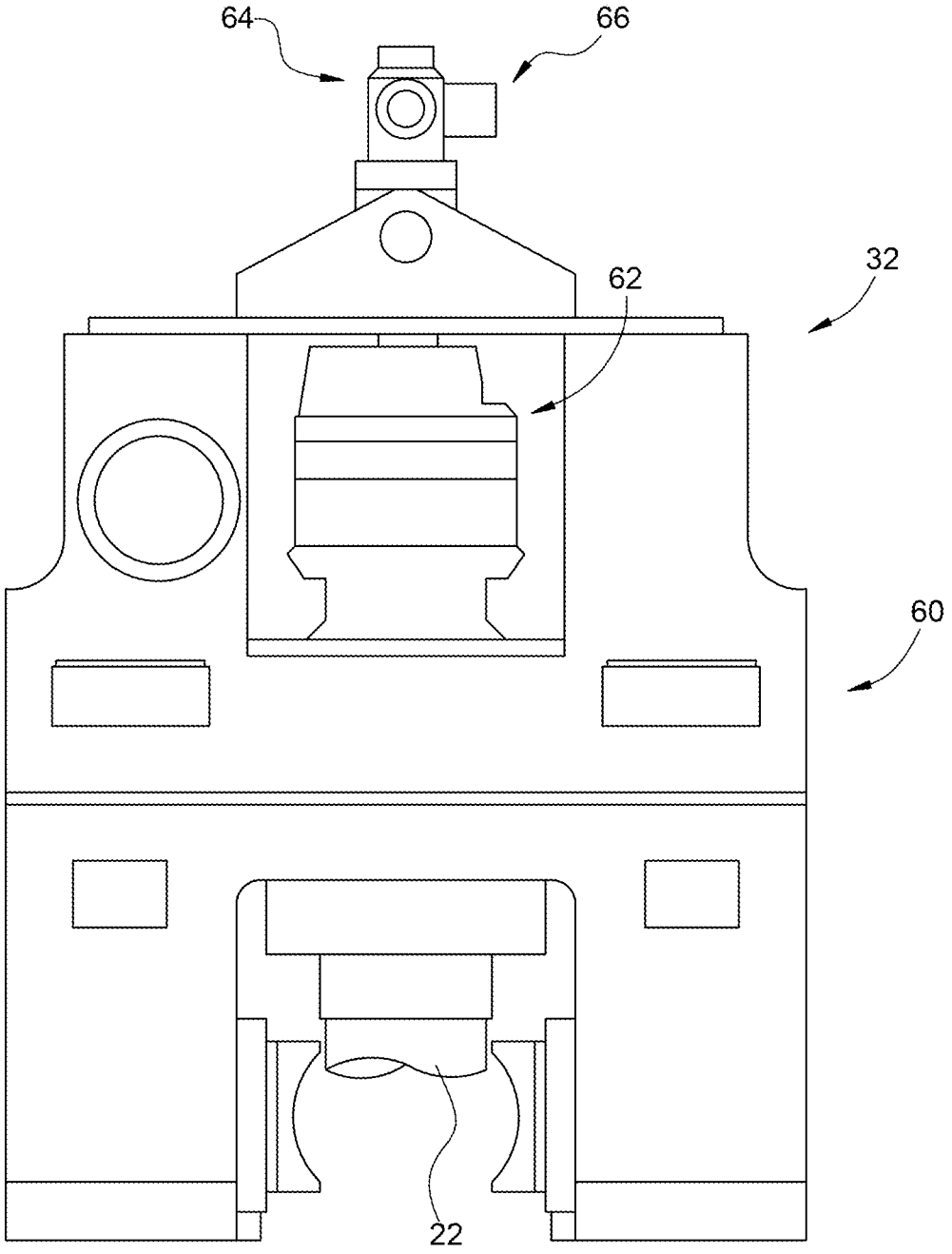
FIG. 2 is a front elevation view of a pile driving system configured to utilize the first example grout plug system of the present invention.

Turning now to FIG. 2 of the drawing, the example drive assembly 32 will now be described in further detail. The example drive assembly 32 comprises a drive housing 60 configured to support a drive motor 62 and a drive shaft assembly 64. The present invention is of particular significance when the design characteristics of the example pile assembly 22 include the application of grout to the interior of at least a portion of the pile assembly 22. Accordingly, the example drive assembly 32 further comprises a grout inlet fitting 66 supported by the drive shaft assembly 64. As will be described in further detail below, grout and/or other material may be pumped through grout fitting 66 and the drive shaft assembly 64 and into a pile assembly 22 before, during, and/or after the pile assembly 22 is driven into the ground 24.

Figure 3:
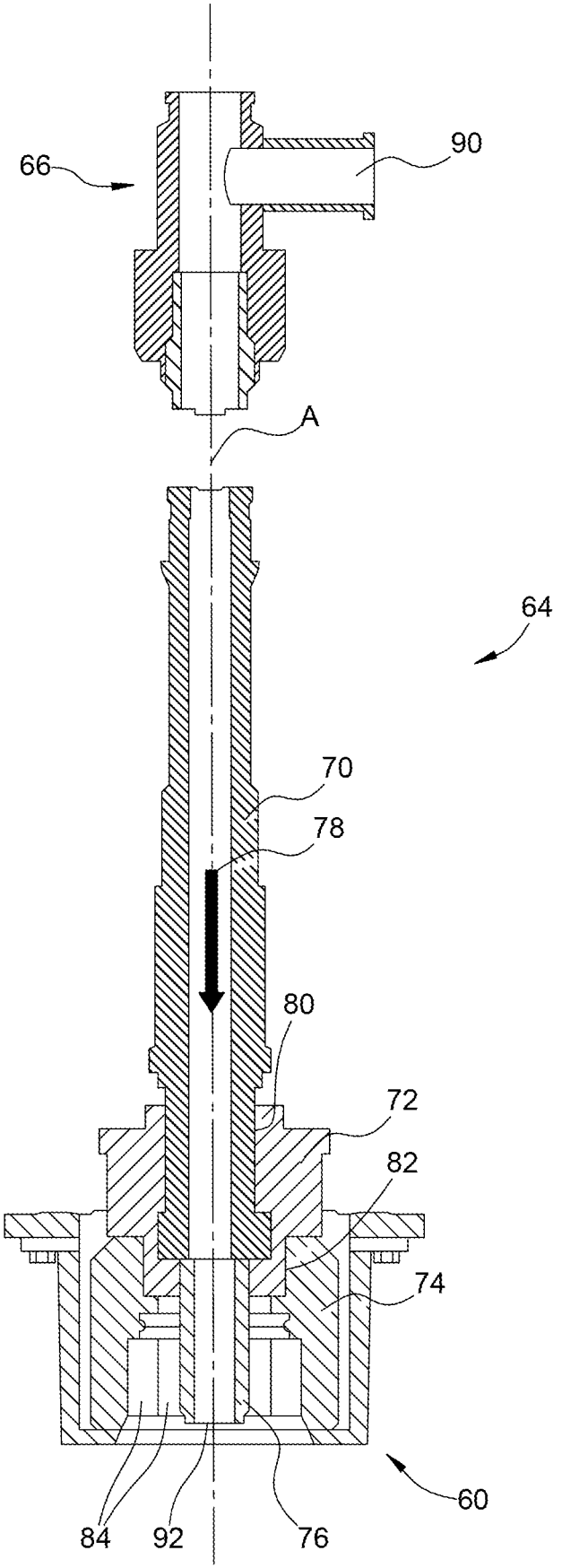
FIG. 3 is a section view illustrating a drive shaft assembly of the pile driving system of FIG. 2.

FIG. 3 illustrates the drive shaft assembly 64 with most of the drive housing 60 and the drive motor 62 removed for clarity. As shown in FIG. 3, the drive shaft assembly 64 comprises a drive shaft 70, drive shaft output member 72, drive shaft socket member 74, and grout tube 76. The drive shaft 70 and grout tube 76 define a grout passageway 78 that extends from the grout inlet fitting 66 to the drive shaft output member 72.

The drive shaft assembly 64 is supported by the drive housing 60 for rotation about a drive axis A relative to the drive housing 60, and the drive motor 62 is arranged to rotate the drive shaft assembly 64 relative to the drive housing 60 and thereby rotate the pile assembly 22 relative to the ground 24. In particular, the drive motor 62 engages the drive shaft 70 such that operation of the drive motor causes axial rotation of the drive shaft about the drive axis A. The drive shaft 70 is in turn coupled to the drive shaft output member 72 by splines 80 or the like such that axial rotation of the drive shaft 70 causes axial rotation of the drive shaft output member 72 relative to the drive axis A. The drive shaft output member 72 is in turn coupled to the drive shaft socket member 74 by complementary drive head surfaces 82 or the like such that axial rotation of the drive shaft output member 72 is transferred to the drive shaft socket member 74. The drive shaft socket member 74 defines pile engaging surfaces 84 or the like configured to engage complementary surfaces defined by the pile assembly 22 such that axial rotation of the drive shaft socket member 74 is transferred to the pile assembly 22. Accordingly, when the pile assembly 22 is in engagement with the drive shaft socket member 74, operation of the drive motor 62 causes axial rotation of the pile assembly 22 about the drive axis A.

The grout tube 76 is supported by the drive shaft output member 72 such that the grout tube 76 rotates with the drive shaft assembly 64. The grout fitting 66 is coupled to the drive shaft 70 such that axial rotation of the drive shaft 70 is not transmitted to the grout fitting 66. The grout fitting 66 thus does not rotate about the drive axis A.

In use, grout may be introduced into the grout passageway 78 through a grout inlet 90 formed in the grout fitting 66 and exits the grout passageway 78 through a grout outlet 92 defined by the grout tube 76.

Referring now to FIGS. 4-11 and 13-17 of the drawing, depicted therein is a first example grout plug assembly 120 constructed in accordance with, and embodying, the principles of the present invention. The details of the first example pile assembly 22 will also be described with reference to FIGS. 4-5 and 11-17.

Figure 8:
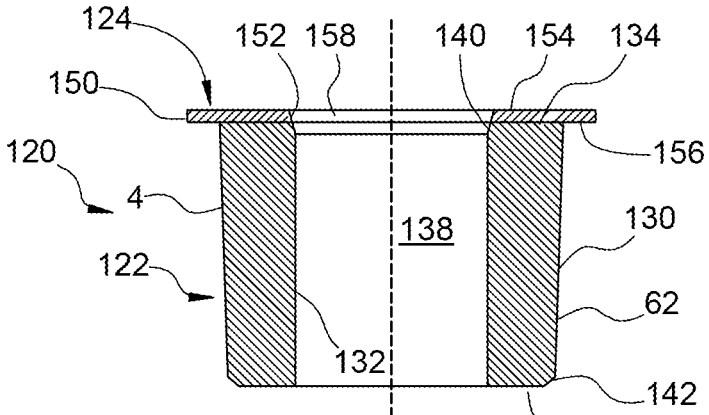
FIG. 8 is a side elevation section view of the first example grout plug assembly.
Figure 9:
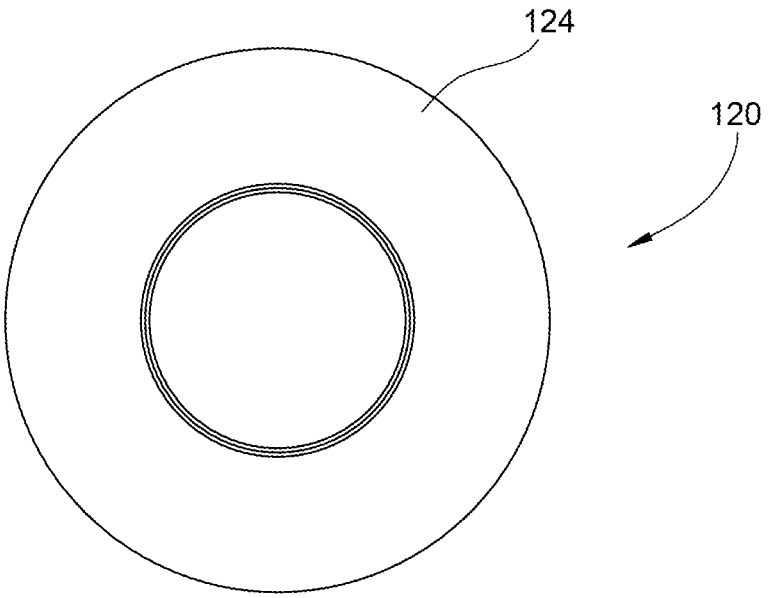
FIG. 9 is a top plan view of the first example grout plug assembly.

The first example grout plug assembly 120 comprises a plug body 122 and a plug cap 124. As best shown in FIG. 8, the example plug body 122 defines plug outer surface 130, a plug inner surface 132, a first plug end surface 134, and a second plug end surface 136. The plug inner surface 132 of the plug body 122 defines a plug passageway 138. A first beveled edge 140 extends between the plug inner surface 132 and the first plug end surface 134. A second beveled edge 142 extends between the plug outer surface 130 and the second plug end surface 136. The example plug body 122 is substantially symmetrical about a plug body axis B. The plug cap 124 defines a cap outer surface 150, a cap inner surface 152, a first cap end surface 154, and a second cap end surface 156. The example cap outer surface 150 is substantially cylindrical, while the cap inner surface 152 is substantially conical. The first and second cap end surfaces 154 and 156 are substantially disc-shaped. The cap inner surface 152 of the plug cap 124 defines a cap opening 158.

The example plug body 122 is made of a resiliently deformable material such as rubber or the like. The example plug cap 124 is made of a substantially rigid material such as metal. The second cap end surface 156 is rigidly secured to the first plug end surface 134 by adhesive and/or mechanical engagement (e.g., screws, bolts, pins, and/or threads).

Figure 7:
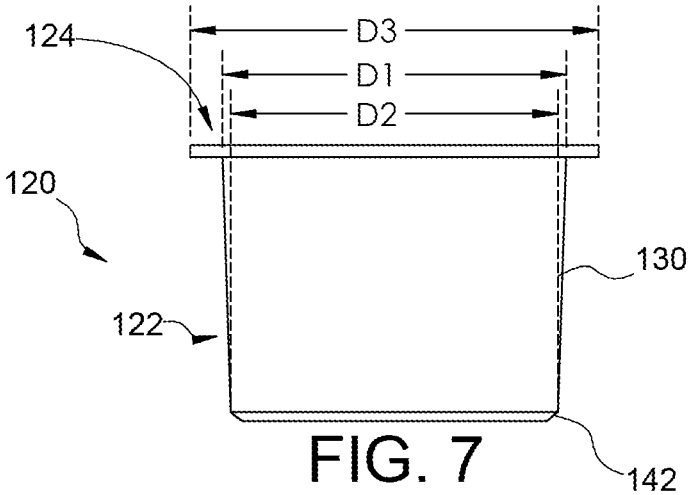
FIG. 7 is a side elevation view of the first example grout plug assembly.
Figure 10:
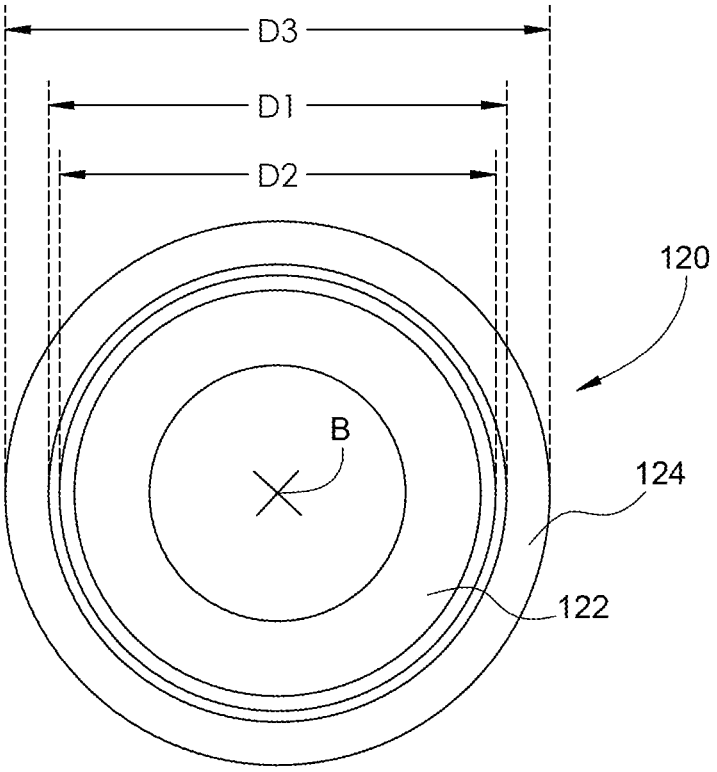
FIG. 10 is a bottom plan view of the first example grout plug assembly.
Figure 11:
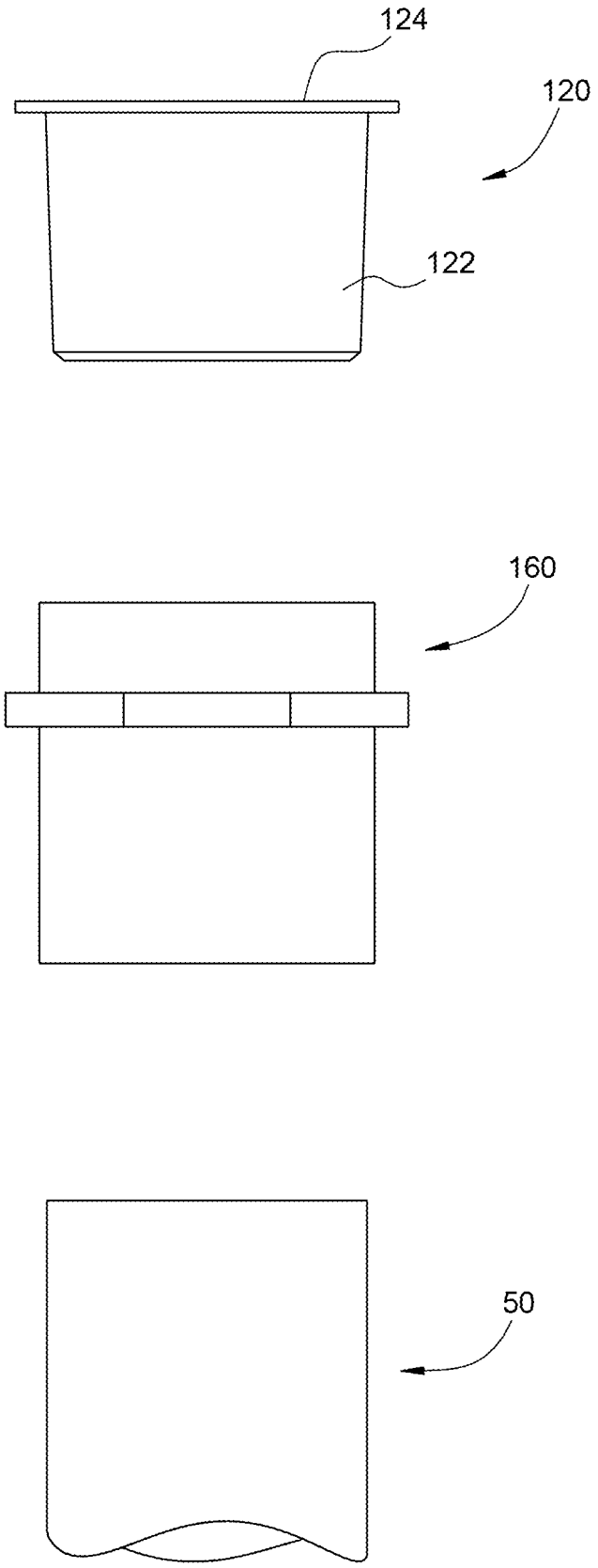
FIG. 11 is an exploded, side elevation view illustrating the first example grout plug assembly, a first example grout coupler, and a first example pile.

As perhaps shown in FIGS. 7 and 10, when viewed along the plug body axis B the plug outer surface 130 defines a first diameter D1 adjacent to the first plug end surface 134 and a second diameter D1 adjacent to the second plug end surface 136. The plug cap 134 defines a third diameter D2 when viewed along the plug body axis B. In the example grout plug assembly 120, the third diameter D3 is larger than the first diameter D1, and the first diameter D1 is larger than the second diameter D2.

Figure 12:
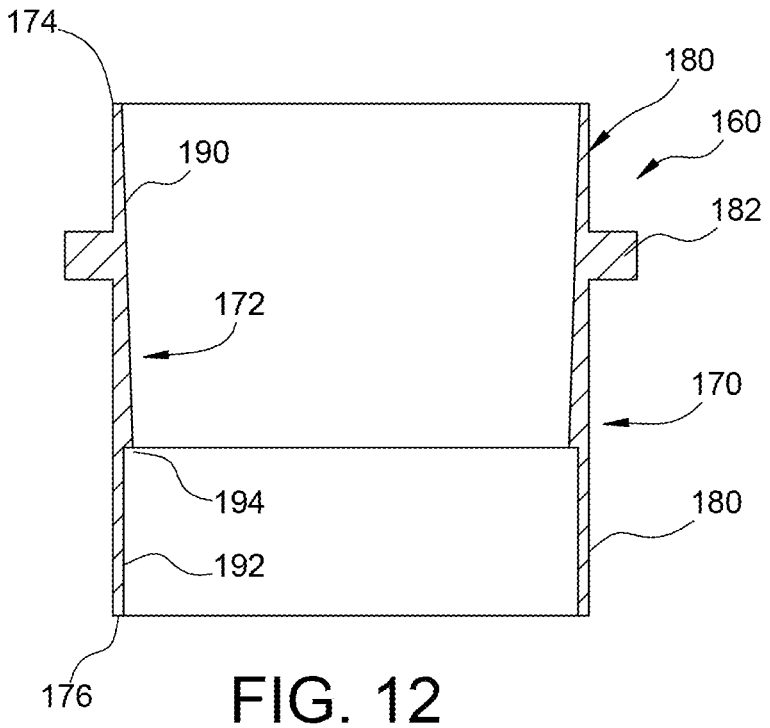
FIG. 12 is a section view of the first example grout coupler.
Figure 13:
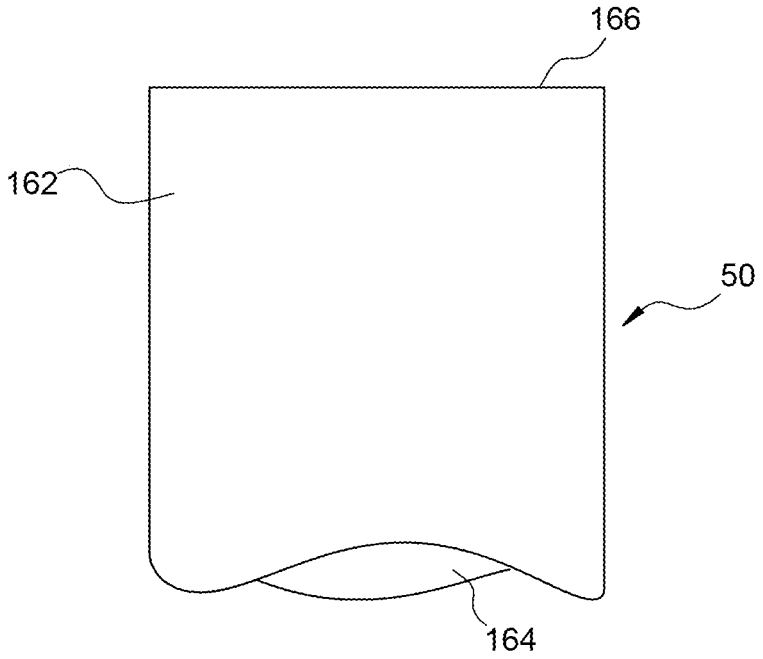
FIG. 13 is side elevation of the first example pile.
Figure 14:
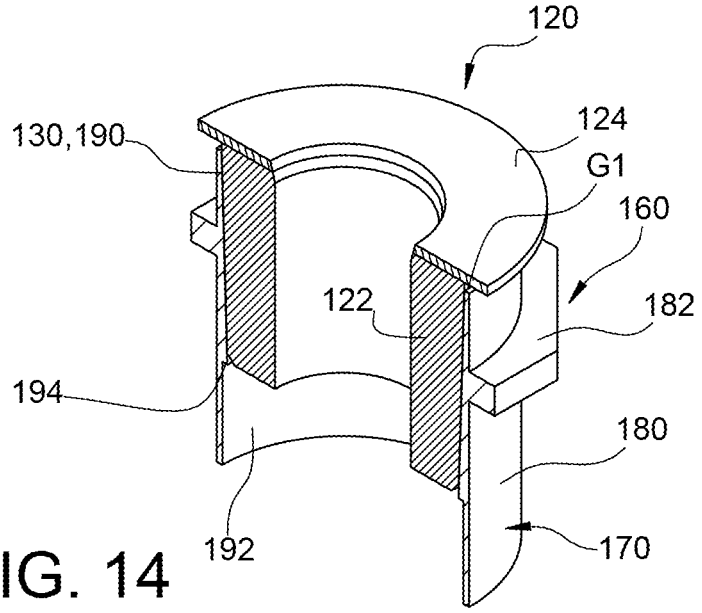
FIG. 14 is a perspective, cut-away view of the first example grout plug assembly supported by the grout coupler, where the first example grout plug assembly is in an expanded configuration.

FIGS. 4, 5, 11-13 illustrate that the example pipe assembly 22 comprises, in addition to one or more pipe members 50, at least one first example pipe coupler 160. The pipe member(s) 50 and coupler(s) 160 are or may be conventional and will be described herein only to that extent helpful to an understanding of the present invention. As perhaps best shown in FIG. 13, the example pipe member 50 is substantially cylindrical and defines a pipe outer surface 162, a pipe inner surface 164, and a pipe proximal end surface 166. As best shown in FIG. 12, the first example pipe coupler 160 defines a coupler outer surface 170, a coupler inner surface 172, a first coupler end surface 174, and a second coupler end surface 176. The example coupler outer surface 170 defines a cylindrical portion 180 and a drive projection 182. The example coupler inner surface 172 defines a first inner surface portion 190, a second inner surface portion 192, and a transition surface portion 194. The first inner surface portion 190 is substantially conical, and a diameter thereof decreases from the first coupler end surface 174 to the transition surface portion 194. The second inner surface portion 190 is substantially cylindrical, and a diameter thereof is smaller than the diameter of the first inner surface portion 190 adjacent to the transition surface portion 194. The transition surface portion 194 is annular. The example first and second coupler end surfaces 174 and 176 are annular.

The example plug outer surface 130 is substantially conical, and the longitudinal axis of the conical shape defined by the plug outer surface 130 is coaxial with the plug body axis B. A longitudinal plane (coplanar with the page in FIG. 8) defined by the plug body axis B intersects the outer surface 130 at first and second lines L1 and L2. The first and second lines L1 and L2 defined by the example grout plug body 122 extend at an angle of approximately 2° relative to the plug body axis B. The angle between the first and second lines L1 and L2 may be within a first range of between 1° and 4° and in any event should be within a second range of between 0° and 5°. The exact size, shape, and dimensions of the example plug inner surface 132 should be predetermined based on the size, shape, and dimensions of the pipe coupler 160 to form a substantially grout-tight seal between the grout plug assembly 120 and the pile assembly 22 as will be described in detail below.

The example plug inner surface 132 is substantially cylindrical, and a longitudinal axis of the cylindrical shape defined by the example plug inner surface 132 is coaxial with the plug body axis B. The exact size, shape, and dimensions of the example plug inner surface 132 are not critical so long as grout may flow therethrough as will be described in further detail below.

Figure 5:
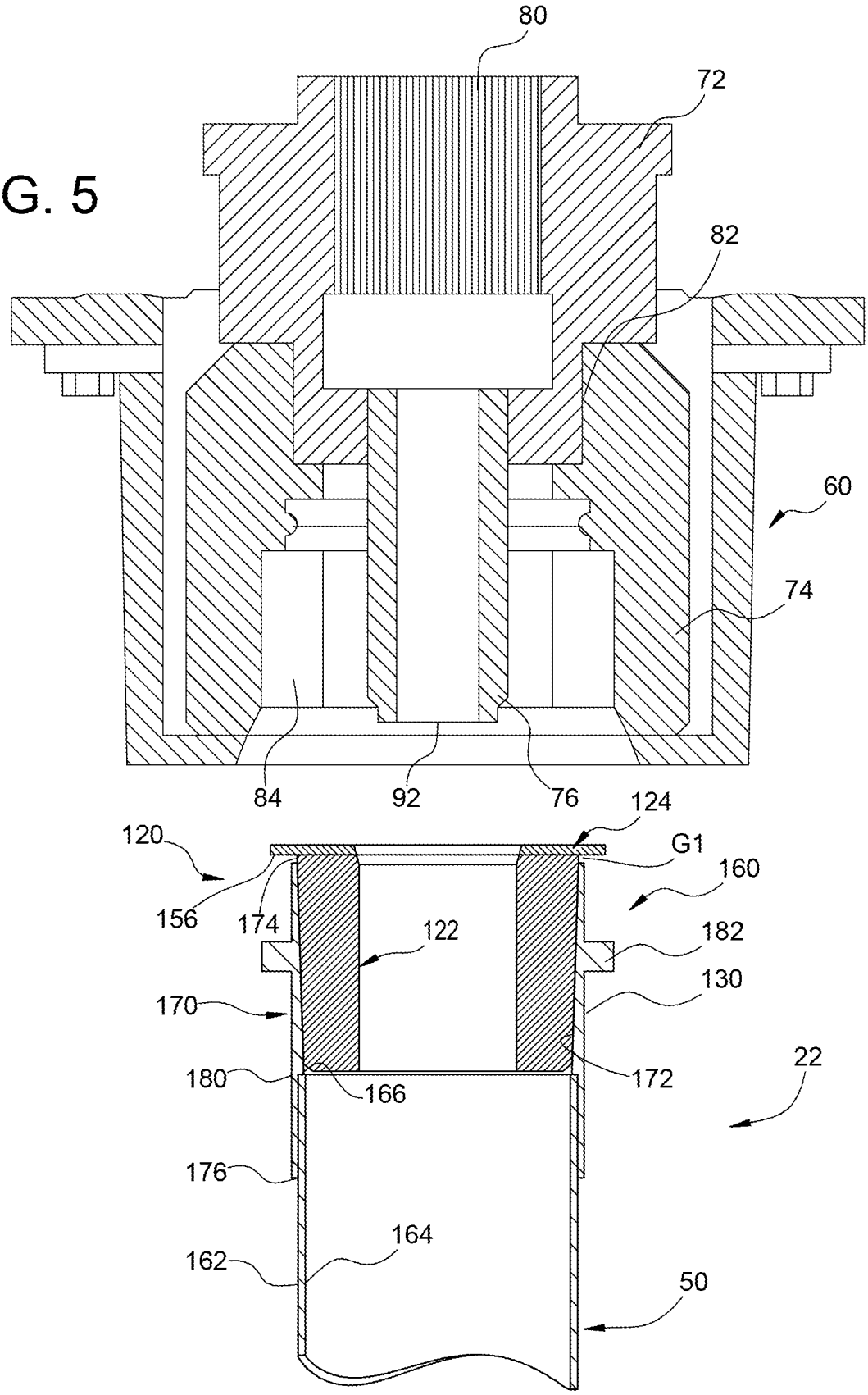
FIG. 5 is a section view of the first example grout plug assembly de-coupled from the drive socket of the drive shaft assembly.
Figure 6:
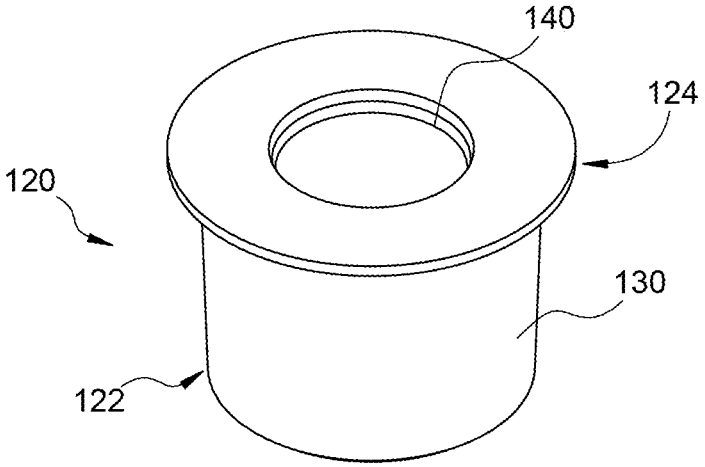
FIG. 6 is a perspective view of the first example grout plug assembly.

As perhaps best shown in FIGS. 5 and 6, the plug outer surface 130 is configured to substantially match the first inner surface portion 190 of the example pipe coupler 160. In the example described herein, the plug outer surface 130 and the first inner surface portion 190 are both substantially conical so that the plug body 122 of the grout plug assembly 120 fits snugly within the pipe coupler 160 as shown in FIG. 5.

Figure 15:
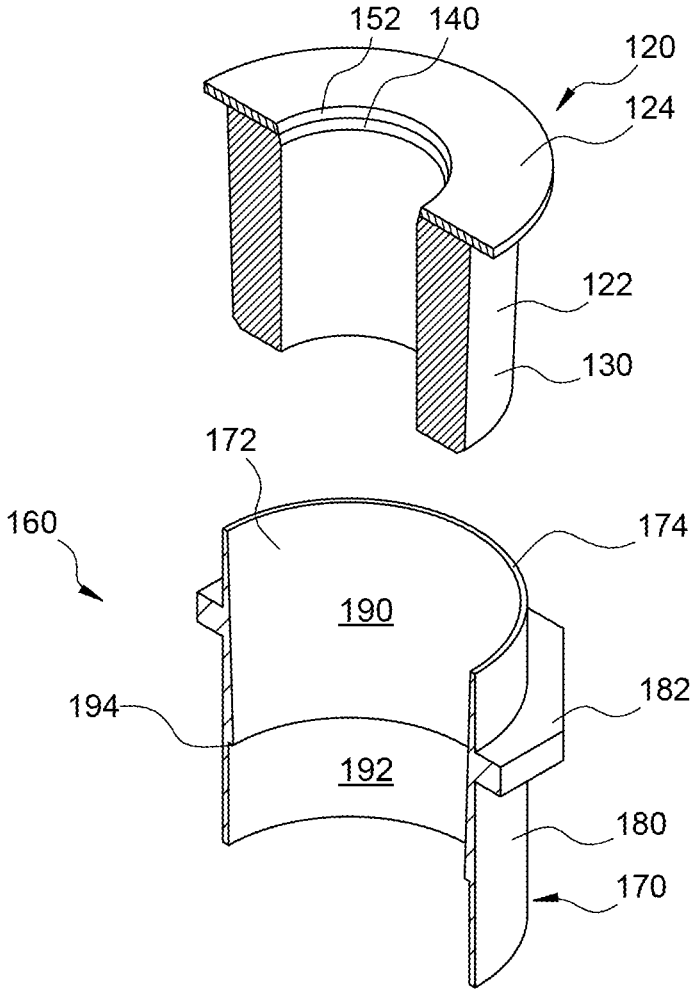
FIG. 15 is a perspective, cut-away view of the first example grout plug assembly detached from the grout coupler.

FIGS. 8 and 15 illustrate that the first beveled edge 140 of the plug body 122 and the cap inner surface 152 are sized and dimensioned to define a continuous surface that is angled or slanted relative to the plug body axis B to facilitate entry of the grout tube 76 into the plug passageway 138.

In use, the pile assembly 22 is initially formed by arranging the pipe member 50 such that the pipe proximal end surface 166 comes into contact with the transition surface portion 194 of the inner surface 172 of the coupler 160. The pipe member 50 may be welded to the coupler 160 to rigidly connect the pipe member 50 to the coupler 160.

Figure 4:
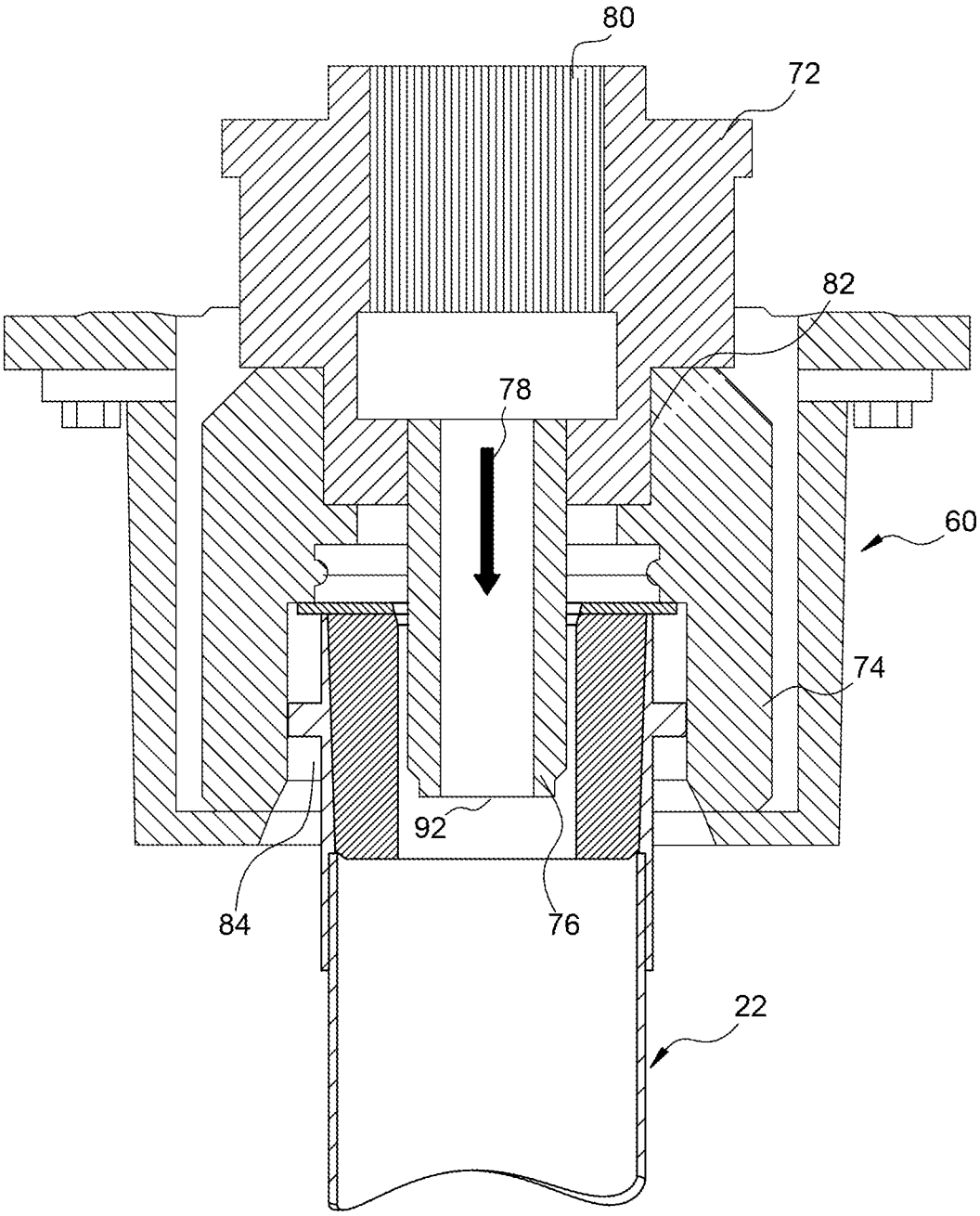
FIG. 4 is a section view of a first example grout plug assembly coupled to a drive socket of the drive shaft assembly.
Figure 16:
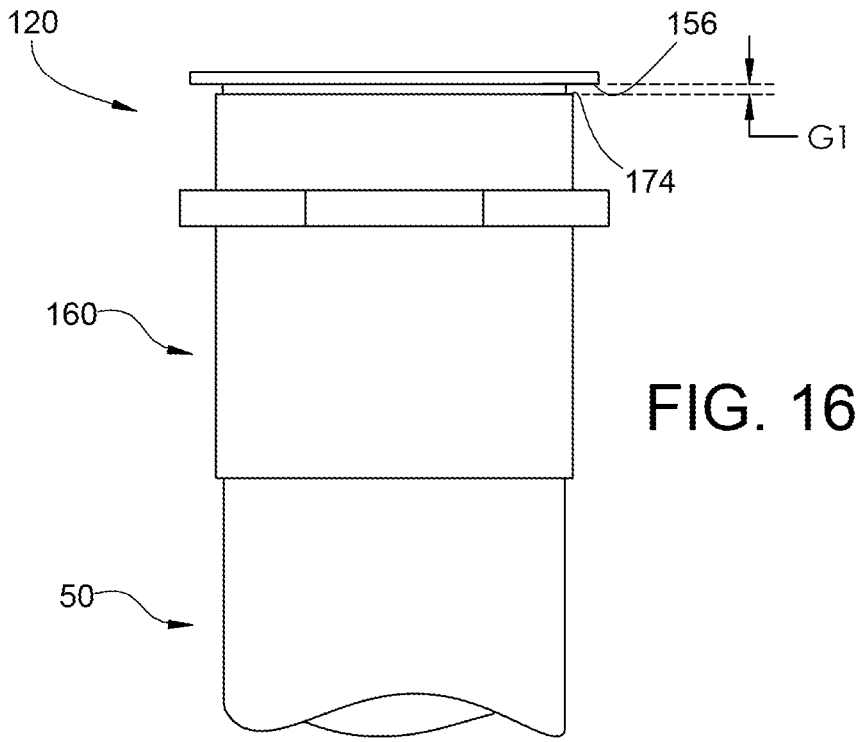
FIG. 16 is a side elevation view illustrating the first example grout plug assembly, the first example grout coupler, and the first example pile with the first example grout plug assembly in the expanded configuration.
Figure 17:
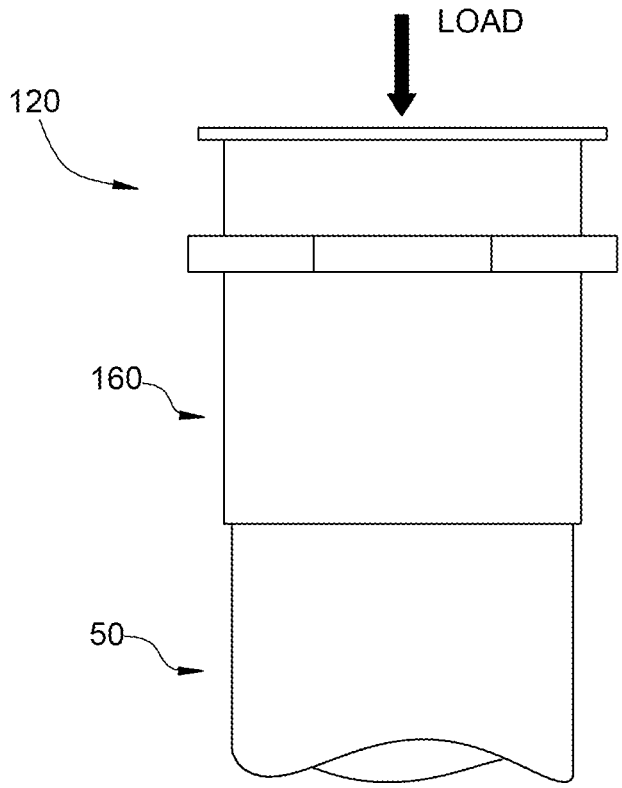
FIG. 17 is a side elevation view illustrating the first example grout plug assembly, the first example grout coupler, and the first example pile with the first example grout plug assembly in a compressed configuration.

The grout plug assembly 120 is next arranged such that the grout plug body 122 is at least partly within the volume defined by the first inner surface portion 190 defined by the coupler 160 as shown in FIGS. 4 and 16. When the grout plug body 122 of the grout plug assembly 120 is at least partly within the pipe coupler 160 and no load is applied to the plug plate 124 towards the plug body 120, a gap G1 exists between the second cap end surface 156 of the plug plate 124 and the first coupler end surface 174 of the coupler 160 as shown in FIGS. 5 and 17. However, FIG. 4 illustrates that, during use with the grout plug assembly 120 within the pipe coupler 160 and with a load applied to the plug plate 124 towards the plug body 120, the gap G1 no longer exists between the second cap end surface 156 of the plug plate 124 and the first coupler end surface 174 of the coupler 160. In particular, the resiliently deformable plug body 122 deforms under load such that the second cap end surface 156 comes into contact with the first coupler end surface 174. The grout plug assembly 120 thus expands under load to form a relatively tight seal that inhibits flow of grout outside of the grout plug assembly 120.

At this point, grout (not shown) is introduced into the grout inlet 90 such that the grout flows through the grout passageway 78 and into the pipe member 50 of the pile assembly 22 and any other pile members 50 connected to the pipe member 50 depicted in the drawing.

II. Second Example Embodiment

Figure 20:
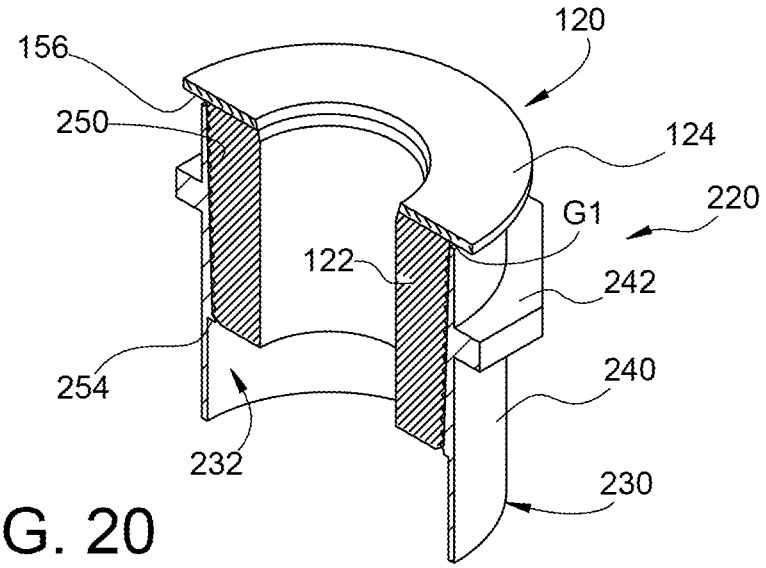
FIG. 20 is a perspective, cut-away view of a second example grout plug assembly attached to the second example grout coupler.
Figure 21:
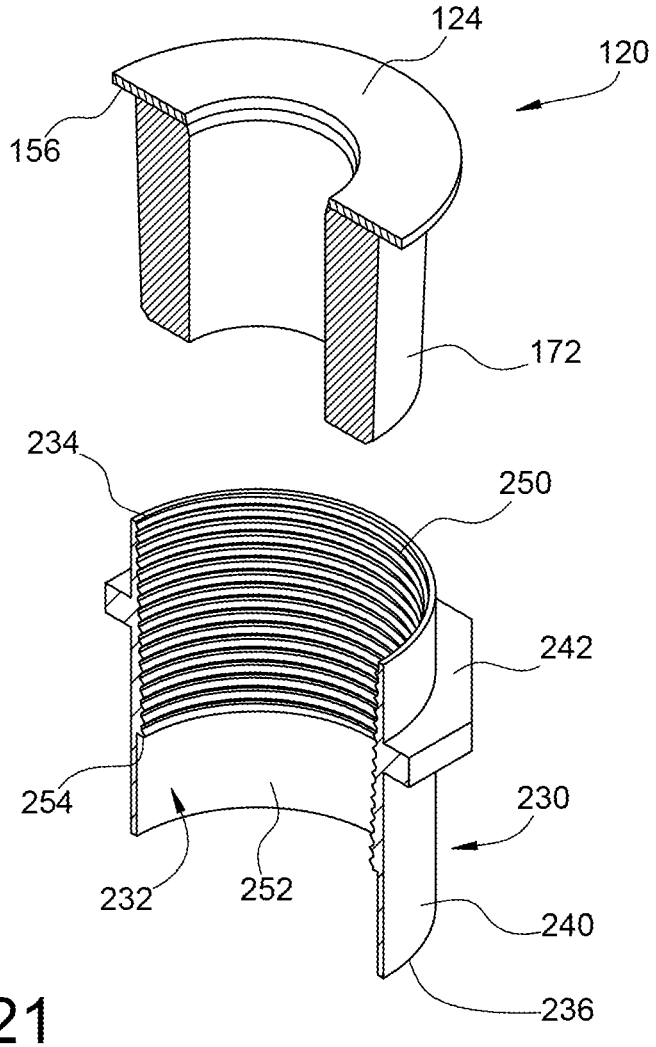
FIG. 21 is a perspective, cut-away view of the second example grout plug assembly detached from the second example grout coupler.

A second example of the present invention will now be described with reference to FIGS. 18-21 of the drawing. In particular, FIGS. 20 and 21 illustrate that the first example grout plug assembly 120 may also be used with a second example pipe coupler 220 forming a part of a second example pile assembly 222. The support system 30 and drive assembly 32 may be used to drive the second example pile assembly 222 into the ground at a desired location and will not be described again herein in detail. The second example pile assembly 222 may further comprise a pipe member like the example pipe member 50 as described above, and the pipe member 50 will also not be described again herein in detail.

Figure 18:
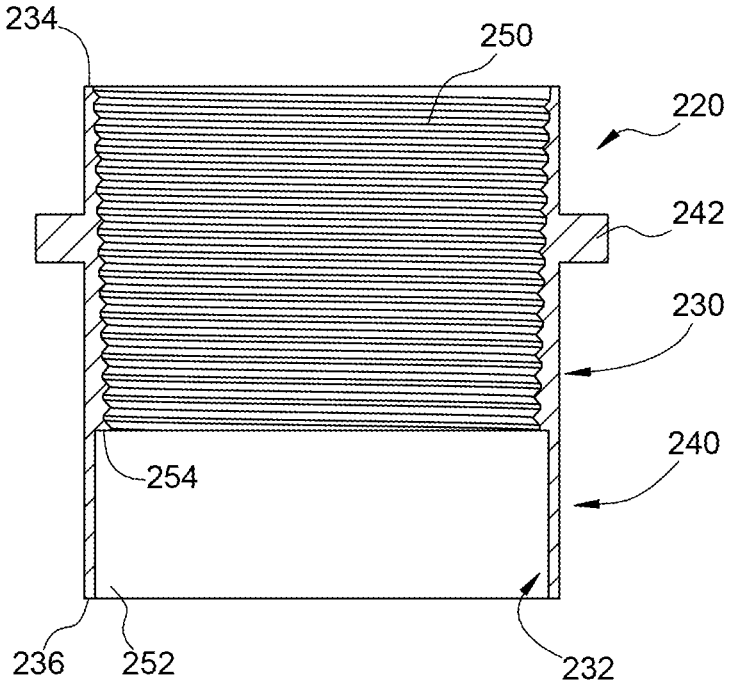
FIG. 18 is a section view of a second example grout coupler.
Figure 19:
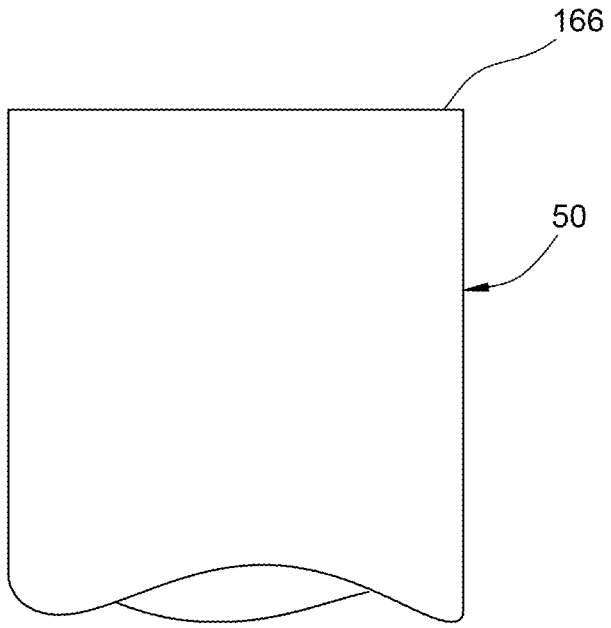
FIG. 19 is side elevation of a second example pile adapted to be connected to the second example grout coupler.

FIGS. 18 and 21 perhaps best illustrate that the second example pipe coupler 220 defines a coupler outer surface 230, a coupler inner surface 232, a first coupler end surface 234, and a second coupler end surface 236. The example coupler outer surface 230 defines a cylindrical portion 240 and a drive projection 242. The example coupler inner surface 232 defines a first inner surface portion 250, a second inner surface portion 252, and a transition surface portion 254. The example first inner surface portion 250 is threaded and substantially conical, and a diameter thereof generally decreases from the first coupler end surface 234 to the transition surface portion 254. The second inner surface portion 250 is substantially cylindrical, and a diameter thereof is smaller than the diameter of the first inner surface portion 250 adjacent to the transition surface portion 254. The transition surface portion 254 is annular. The example first and second coupler end surfaces 234 and 236 are annular.

As with the pile assembly 22, the pile assembly 222 is formed by arranging the pipe member 50 such that the pipe proximal end surface 166 comes into contact with the transition surface portion 254 of the inner surface 232 of the coupler 220. The pipe member 50 may be welded to the coupler 220 to rigidly connect the pipe member 50 to the coupler 220.

The grout plug assembly 120 is next arranged such that the grout plug body 122 is at least partly within the volume defined by the first inner surface portion 250 defined by the coupler 220 as shown in FIG. 20. When the grout plug body 122 of the grout plug assembly 120 is at least partly within the pipe coupler 220 and no load is applied to the plug plate 124 towards the plug body 120, a gap G1 exists between the second cap end surface 156 of the plug plate 124 and the first coupler end surface 234 of the coupler 220 as shown in FIG. 20. However, during use with the grout plug assembly 120 within the pipe coupler 220 and with a load applied to the plug plate 124 towards the plug body 120, the gap G1 no longer exists between the second cap end surface 156 of the plug plate 124 and the first coupler end surface 234 of the coupler 220. In particular, the resiliently deformable plug body 122 deforms under load such that the second cap end surface 156 comes into contact with the first coupler end surface 174. The grout plug assembly 120 thus expands under load to form a relatively tight seal that inhibits flow of grout outside of the grout plug assembly 120.

At this point, grout (not shown) is introduced into the grout inlet 90 such that the grout flows through the grout passageway 78 and into the pipe member 50 of the pile assembly 22 and any other pile members 50 connected to the pipe member 50 depicted in the drawing.

III. Third Example Embodiment

Figure 22:
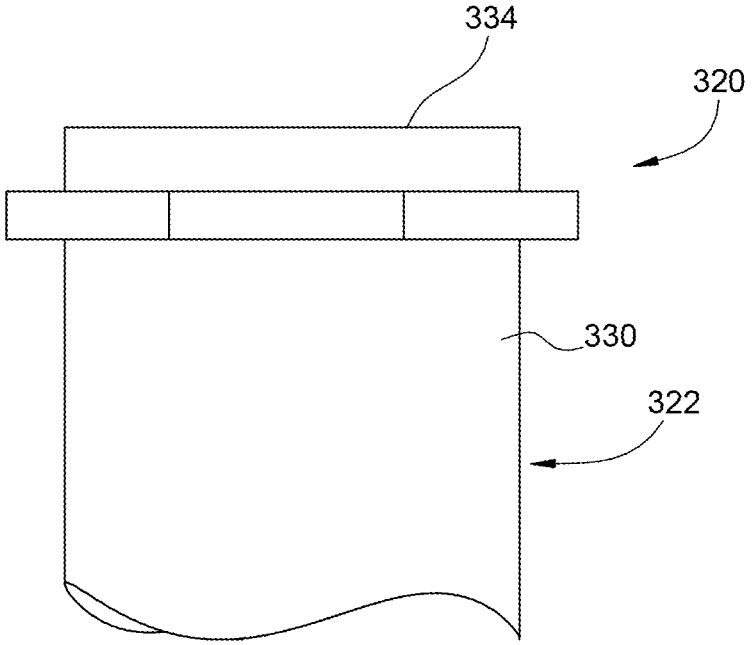
FIG. 22 is a perspective view of a third example pile member that may be used with the first example grout plug assembly.
Figure 23:
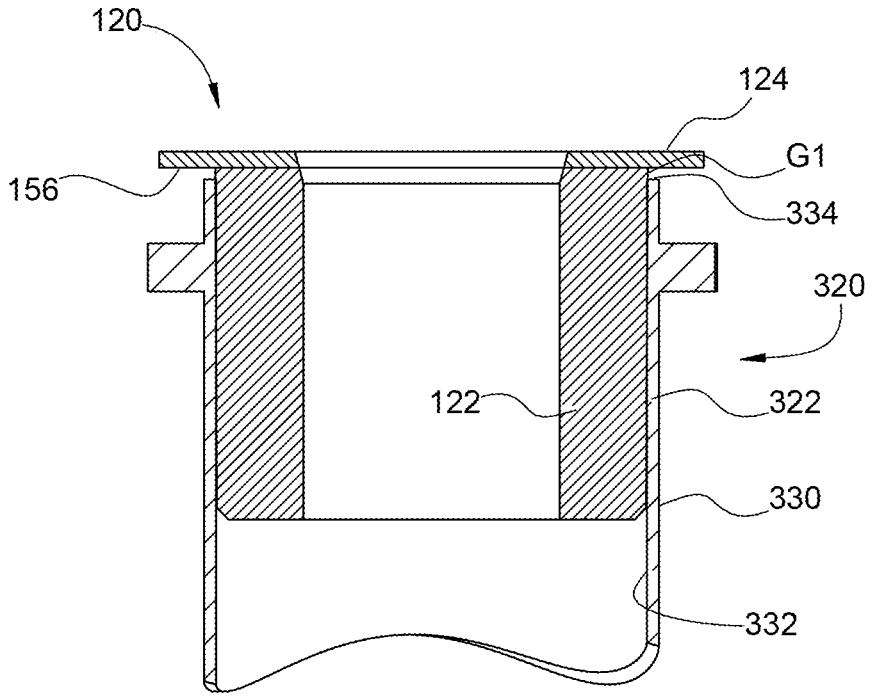
FIG. 23 is a side elevation section view illustrating the third example grout plug assembly and the second example pile with the third example grout plug assembly in an expanded configuration.
Figure 24:
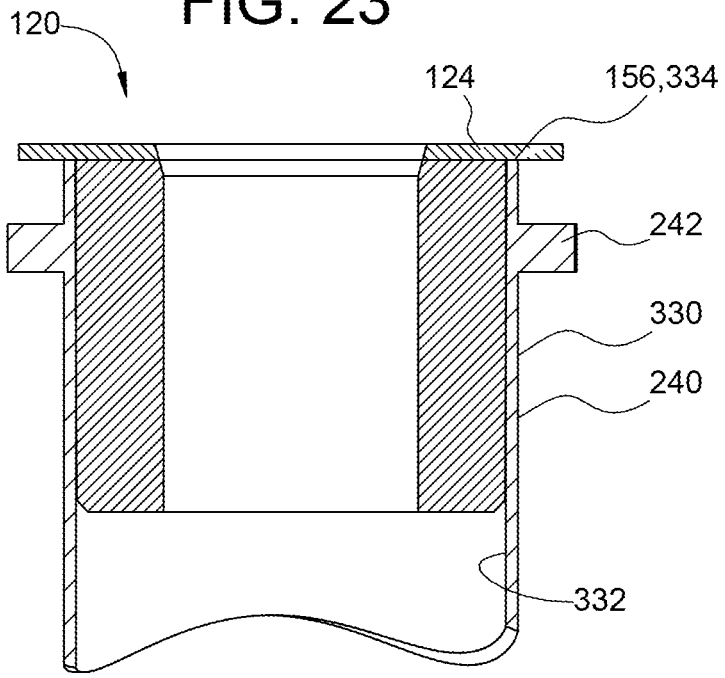
FIG. 24 is a side elevation view illustrating the third example grout plug assembly and the second example pile with the third example grout plug assembly in a compressed configuration.

A third example of the present invention will now be described with reference to FIGS. 22-24 of the drawing. FIGS. 22-24 illustrate that the first example grout plug assembly 120 may also be used with a third example pipe pile assembly 320 comprising an example pile member 322. The support system 30 and drive assembly 32 may be used to drive the third example pile assembly 320 into the ground at a desired location and will not be described again herein in detail. The third example pile assembly 320 may further comprise additional pipe members like the example pipe member 50 as described above.

FIGS. 22-24 illustrate that the second example pipe member 322 defines a pipe outer surface 330, a pipe inner surface 332, and a pipe proximal end surface 334. The pipe outer surface 330 defines a cylindrical portion 340 and a drive projection 342. The pipe inner surface 332 is cylindrical, and the pipe proximal end surface 334 is annular.

The example pile member 322 does not require the use of a separate coupler. Instead, the grout plug assembly 120 is arranged such that the grout plug body 122 is at least partly within the volume defined by an upper portion of the pipe inner surface 332 as shown in FIGS. 22 and 23. When the grout plug body 122 of the grout plug assembly 120 is at least partly within the pipe member 322 and no load is applied to the plug plate 124 towards the plug body 120, a gap G1 exists between the second cap end surface 156 of the plug plate 124 and the first coupler end surface 234 of the coupler 220 as shown in FIG. 23. However, during use with the grout plug assembly 120 within the pipe member 322 and with a load applied to the plug plate 124 towards the plug body 120, the gap G1 no longer exists between the second cap end surface 156 of the plug plate 124 and the proximal end surface 334 of the coupler 220. In particular, the resiliently deformable plug body 122 deforms under load such that the second cap end surface 156 comes into contact with the proximal end surface 334 of the pipe member 222. The grout plug assembly 120 thus expands under load to form a relatively tight seal that inhibits flow of grout outside of the pipe member 222.

At this point, grout (not shown) is introduced into the grout inlet 90 such that the grout flows through the grout passageway 78 and into the pipe member 322 of the pile assembly 320 and any other pile members 50 connected to the pipe member 50 depicted in the drawing.

What is claimed is:

1. A grout plug assembly for use in forming a pipe pile system defining at least one pile assembly inner surface portion, where the grout plug assembly comprises:

a resiliently deformable plug body defining a plug outer surface, a plug inner surface, a first plug end surface, a second plug end surface, where the plug inner surface defines a plug passageway; and a substantially rigid plug cap defining a cap outer surface, a cap inner surface, a first cap end surface, and a second cap end surface; wherein the second cap end surface is rigidly secured to the first plug end surface; and the plug outer surface is contiguous with the at least one pile assembly inner surface portion of the pipe pile system during formation of the pipe pile system.

2. The grout plug assembly as recited in claim 1, in which the plug outer surface is conical.

3. The grout plug assembly as recited in claim 2, in which:

the resiliently deformable plug body defines a plug body axis; and the plug outer surface extends at an angle of between 1 degrees and 4 degrees relative to the plug body axis.

4. The grout plug assembly as recited in claim 2, in which:

the resiliently deformable plug body defines a plug body axis; and the plug outer surface extends at an angle of approximately 2 degrees relative to the plug body axis.

5. The grout plug assembly as recited in claim 1, in which:

the resiliently deformable plug body defines a plug body axis; and the plug outer surface extends at an angle of between 0 degrees and 5 degrees relative to the plug body axis.

6. The grout plug assembly as recited in claim 1, in which the pipe pile system comprises at least one pipe pile defining the at least one pile assembly inner surface portion.

7. The grout plug assembly as recited in claim 1, in which the pipe pile system comprises at least one a coupler defining the at least one pile assembly inner surface portion.

8. The grout plug assembly as recited in claim 1, in which the pipe pile system comprises at least one pipe pile and at least one coupler defining the at least one pile assembly inner surface portion.

9. The grout plug assembly as recited in claim 1, in which the at least one pile assembly inner surface portion is conical.

10. The grout plug assembly as recited in claim 1, in which the at least one pile assembly inner surface portion is threaded.

11. A grout plug assembly as recited in claim 1, in which:

the resiliently deformable plug body defines a first beveled edge and a second beveled edge; and the cap inner surface is conical.

12. The grout plug assembly as recited in claim 1, in which the pipe pile system comprises at least one pipe pile defining the at least one pile assembly inner surface portion.

13. The grout plug assembly as recited in claim 1, in which the pipe pile system comprises at least one a coupler defining the at least one pile assembly inner surface portion.

14. The grout plug assembly as recited in claim 1, in which the pipe pile system comprises at least one pipe pile and at least one coupler defining the at least one pile assembly inner surface portion.

15. The method of forming a pipe pile system defining at least one pile assembly inner surface portion, comprising the steps of:

providing a resiliently deformable plug body defining a plug outer surface, a plug inner surface, a first plug end surface, a second plug end surface, where the plug inner surface defines a plug passageway, and the plug outer surface is sized and dimensioned based on size and dimensions of the at least one pile assembly inner surface portion of the pipe pile system; and providing a substantially rigid plug cap defining a cap outer surface, a cap inner surface, a first cap end surface, and a second cap end surface;

forming a grout plug by rigidly securing the second cap end surface to the first plug end surface; and arranging the grout plug such that the plug outer surface is contiguous with the at least one pile assembly inner surface portion during formation of the pipe pile system.

16. The method as recited in claim 15, in which the step of providing the resiliently deformable plug body comprises the step of configuring the plug outer surface to be conical.

17. The method as recited in claim 15, in which the step of providing the resiliently deformable plug body comprises the steps of:

defining a plug body axis of the resiliently deformable plug body; and configuring the plug outer surface to extend at an angle of between 1 degrees and 4 degrees relative to the plug body axis.

18. The method as recited in claim 15, in which:

the step of providing the resiliently deformable plug body comprises the step of forming the resiliently deformable plug body to define a first beveled edge and a second beveled edge; and the step of providing the substantially rigid plug cap comprises the step of configuring the cap inner surface to be conical.

19. A pile driving system for use in forming a pipe pile system defining at least one pile assembly inner surface portion, where pile driving system comprises:

a support system for supporting at least one pipe pile above a desired location in the ground;

a drive assembly for displacing the at least one pipe pile into the ground at the desired location; and a grout plug assembly comprising a resiliently deformable plug body defining a plug outer surface, a plug inner surface, a first plug end surface, a second plug end surface, where the plug inner surface defines a plug passageway, and a substantially rigid plug cap defining a cap outer surface, a cap inner surface, a first cap end surface, and a second cap end surface, where the second cap end surface is rigidly secured to the first plug end surface, and the plug outer surface is sized and dimensioned to engage the at least one pile assembly inner surface portion of the pipe pile system during formation of the pipe pile system; wherein the at least one plug outer surface is contiguous with the at least one pile assembly inner surface portion;

at least one of the support system and the drive system is operated to displace the pile system into the ground; and grout is displaced through the plug passageway when the pile system is displaced into the ground.

20. A pile driving system as recited in claim 19, in which:

the resiliently deformable plug body defines a plug body axis; and the plug outer surface extends at an angle of between 1 degrees and 4 degrees relative to the plug body axis.

* * * * *